US006626105B1

(12) United States Patent
Linehan

(10) Patent No.: US 6,626,105 B1
(45) Date of Patent: Sep. 30, 2003

(54) SELF-INKING INK STAMP

(76) Inventor: Denis Patrick Linehan, 14623 E. 63rd St. S., Derby, KS (US) 67037

( * ) Notice: Subject to any disclaimer, the term of this patent is extended or adjusted under 35 U.S.C. 154(b) by 0 days.

(21) Appl. No.: 10/267,245

(22) Filed: Oct. 9, 2002

(51) Int. Cl.[7] ..... B41K 1/08

(52) U.S. Cl. ..... 101/334; 101/104; 101/327; 101/405

(58) Field of Search ..... 101/333, 405, 101/334, 406, 327, 324, 125, 103, 104

(56) References Cited

U.S. PATENT DOCUMENTS

| | | | | |
|---|---|---|---|---|
| 38,315 A | | 3/1863 | McClement | |
| 1,149,508 A | | 8/1915 | Eavenson | |
| 1,353,994 A | | 9/1920 | Folger et al. | |
| 1,518,727 A | | 12/1924 | Bornstein | |
| 1,607,849 A | | 11/1926 | Schulz | |
| 1,920,058 A | | 7/1933 | Buck | |
| 3,490,370 A | | 1/1970 | Pfannenschwarz | |
| 3,631,799 A | | 1/1972 | Funahashi | |
| 3,714,894 A | | 2/1973 | Robinson | |
| 4,054,093 A | | 10/1977 | Funahashi | |
| 4,291,622 A | | 9/1981 | Bengtsson | |
| 4,432,281 A | | 2/1984 | Wall et al. | |
| 4,838,158 A | | 6/1989 | Marshall et al. | |
| 4,841,860 A | | 6/1989 | Fehling | |
| 5,048,415 A | | 9/1991 | Shih | |
| 5,771,806 A | | 6/1998 | Imamaki | |
| 5,809,886 A | * | 9/1998 | Faber | 101/334 |
| 6,189,451 B1 | * | 2/2001 | Pichler | 101/333 |
| 6,360,658 B1 | | 3/2002 | Benson | |
| 6,453,813 B1 | * | 9/2002 | Faber | 101/405 |

* cited by examiner

*Primary Examiner*—Andrew H. Hirshfeld
*Assistant Examiner*—Kevin D. Williams
(74) *Attorney, Agent, or Firm*—Kenneth H. Jack; Davis & Jack, L.L.C.

(57) ABSTRACT

A self-inking ink stamp consisting of a platen having upper and lower surfaces, having a slot or aperture extending from the lower surface to the upper surface, and having lugs and slide tracks respectively extending outwardly and downwardly from the platen, the lugs and slide tracks adapting the platen for rotating and linearly moving from an inking position to a stamping position; an "H" clip; a first ink stamping die fixedly attached to the upper surface of the platen; a second interchangeable ink stamping die received by the "H" clip; and a cantilevered arm having proximal and distal ends, the proximal end of the cantilevered arm being adhesively mounted upon the platen, the distal end of the cantilevered arm being received by the "H" clip; the cantilevered arm extending the second interchangeable ink stamping die upwardly through the slot or aperture.

9 Claims, 3 Drawing Sheets

SELF-INKING INK STAMP

FIELD OF THE INVENTION

This invention relates to apparatus for ink printing. More particularly, this invention relates to hand operated self-inking ink stamp printers.

BACKGROUND OF THE INVENTION

Self-inking stamping devices of the type described in U.S. Pat. No. 4,432,281 issued Feb. 21, 1984 to Wall, et al., are typically adapted for ink printing of a fixed set of printed indicia (e.g., letters, numerals, etc.) via fixed adhesive applications of rubber printing dies upon the stamp's platen. Such self-inking ink stamps typically have no capacity for interchangeability of ink stamping dies. As a result, such stamps are typically unable to stamp a current calendar date. The instant invention overcomes such deficiency by providing a mechanically simple and economically constructed modification of such ink stamps which enables such ink stamps to support and perform printing with both fixed and interchangeable ink stamping dies.

BRIEF SUMMARY OF THE INVENTION

A primary structural component of the instant inventive self-inking ink stamp comprises a platen including a plate member having an upper surface, and having a lower surface. Preferably, the plate member of the platen is generally circular or rectangular in shape, though suitably such member may assume other geometric configurations such as a square or an oval. The required platen is preferably composed of durable plastic, though other materials such as wood or metal may be suitably utilized.

The required platen element necessarily further includes or incorporates means for facilitating linear and rotating motion within a common self-inking ink stamp housing of the type described in Wall, et al., supra, such motion being between inking and stamping positions. Preferably, such means comprises oppositely extending lugs or journals facilitating pivoting motion and guiding linear sliding motion, and further comprises paired downwardly extending slide tracks for receiving rotation guiding lugs which commonly extend inwardly and oppositely from such typical self-inking ink stamp housing. Suitably, other linear and rotary motion guiding means may be incorporated as a part of or mechanically associated with the platen such as rack and pinion combinations or tie, track, and pulley combinations. Structures associated with the preferred lug and slide track means most advantageously comprise wholly formed plastic injection molded components. Also preferably, a slide track reinforcing wall or ridge is further incorporated, the wall spanning between, interconnecting, and reinforcing the preferred downwardly extending slide tracks.

The platen of the instant inventive self-inking ink stamp necessarily further comprises a slot or aperture extending from its plate's lower surface to its plate's upper surface, the slot or aperture being loosely fitted for receipt of an upwardly extending removably attachable ink stamping die. A traditional rubber or elastomeric ink stamping die is preferably adhesively mounted upon an upper surface area of the platen which is not occupied by the interchangeable die receiving slot or aperture.

A further necessary component of the instant inventive ink stamp comprises an elongated "H" clip whose upwardly and downwardly extending arms respectively define upwardly and downwardly opening stamping die receiving channels. Preferably, the "H" clip comprises semi-rigid and extruded vinyl plastic, allowing the upwardly and downwardly extending arms to flexibly and respectively grasp the interchangeable die and an "H" clip mounting ridge in the manner of spring clips. Suitably, the "H" clip may alternately comprise metal.

Means for interconnecting the "H" clip and the platen are necessarily provided, such means preferably comprising a plastic cantilevered arm having proximal and distal ends. The distal end of the cantilevered arm preferably forms the "H" clip mounting ridge which is nestingly received by the downwardly extending arms of the preferred vinyl "H" clip. The proximal end of the cantilevered arm is preferably fixedly attached to the platen. Necessarily, the preferred cantilevered arm "H" clip interconnecting means is configured for extending an ink stamping die held by the "H" clip upwardly through the platen's slot or aperture. Also preferably, the cross-sectional shape of the cantilevered arm has a "J" configuration with the tail of the "J" forming the "H" clip mounting ridge and supporting the "H" clip and interchangeable die. The head of the "J" (i.e., proximal end of the cantilevered arm) is preferably adhesively attached to under surfaces of the platen, utilizing the lower surface of the platen's plate and a side surface of the platen's preferred reinforcing wall as gluing surfaces. Suitably, the proximal end of the preferred cantilevered arm may be alternately attached to inner surfaces of the platen's preferred slide tracks, such attachment functionally replacing the preferred slide track supporting wall or flange. Also suitably, the attachments of the proximal end of the preferred cantilevered arm to the platen may alternately comprise wholly formed joints.

In use of the instant inventive self-inking ink stamp, and assuming such stamp is mounted within a housing of the type described in Wall '281, the platen is rotated and linearly moved to its ink stamping position, and held in such position. Thereafter, forceps or tweezers are utilized to grasp the "H" clip from above, drawing the "H" clip upwardly away from the upturned distal end of the preferred "J" configured cantilevered arm. Upon disengagement of the "H" clip and its previously received interchangeable ink stamping dies, such dies may be interchanged with different ink stamping dies. For example, the previously received dies may represent a past calendar date, while the immediately interchanged dies may represent a current calendar date. Thereafter, the "H" clip and dies assembly is remounted over the distal end of the "J" shaped cantilevered arm. Thereafter, self-inking stamping may proceed in normal fashion.

Accordingly, it is an object of the present invention to provide a self-inking ink stamp which provides a mechanically simple and economical means for interchanging stamping die elements. It is a further object of the present invention to provide such an ink stamp which incorporates an "H" clip which dually and interchangeably engages overlying ink stamping dies and underlying "H" clip mounting means.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
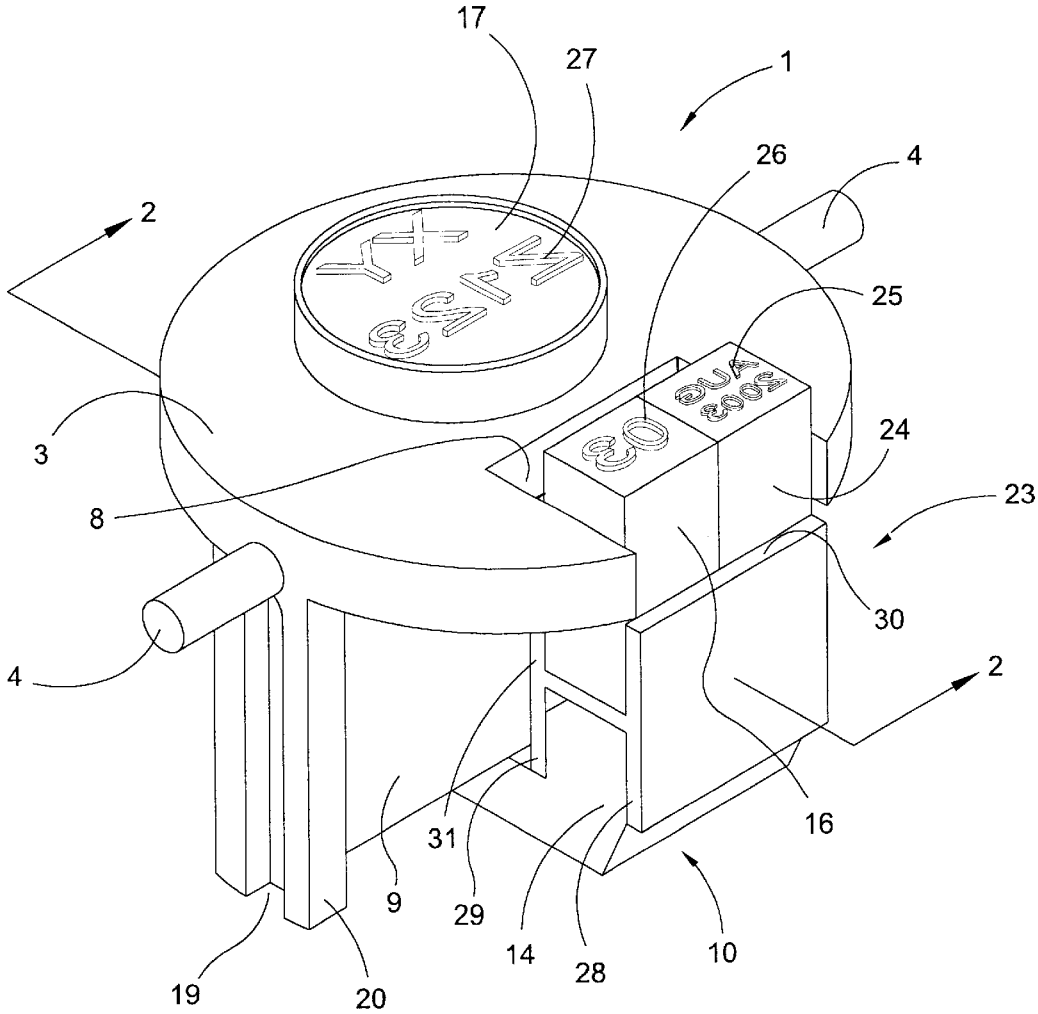
FIG. 1 is an isometric view of the instant inventive self-inking ink stamping die.

Referring now to the drawings, and in particular to FIG. 1, the instant inventive self-inking ink stamp is referred to generally by Reference Arrow 1, the stamp 1 having a platen comprising a circular plate 3, oppositely extending lugs or journals 4, and comprising downwardly extending slide tracks 20 having slide channels 19, the slide tracks 20 and slide channels 19 being positioned at opposite ends of a reinforcing wall 9.

Referring further to FIG. 1, a first rubber ink stamping die 17 is adhesively mounted upon the upper surface of plate 3, such fixed ink stamping die 17 having raised characters 27. Immediately adjacent to the fixed ink stamping die 17, rubber block dies 16 and 24 are slidably and interchangeably mounted within slot 8, dies 16 and 24 having raised characters 26 and 25 similar to those of die 17.

Figure 2:
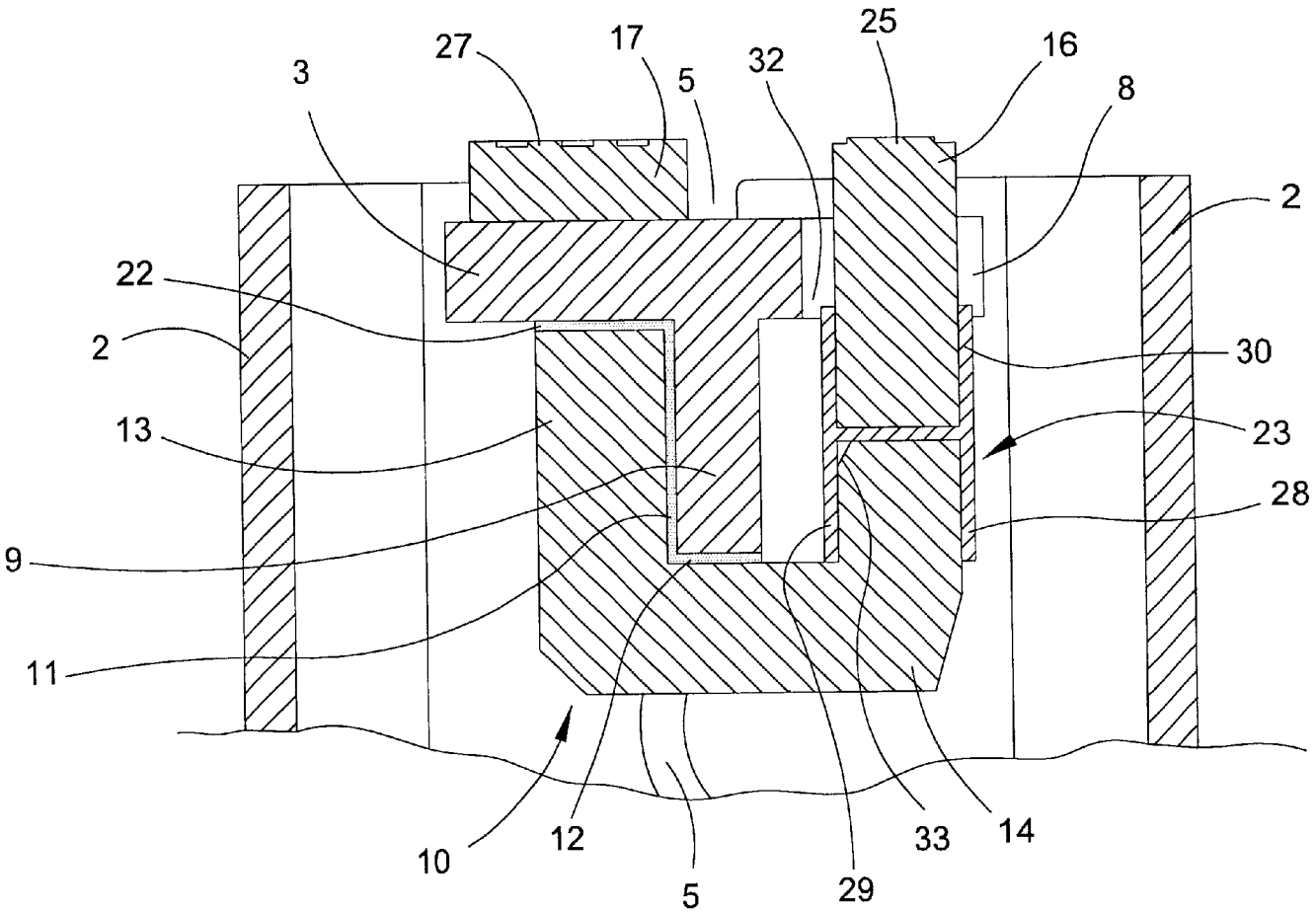
FIG. 2 is a sectional view as indicated in FIG. 1.

Referring simultaneously to FIGS. 1 and 2, an extruded vinyl plastic "H" clip is referred to generally by Reference Arrow 23, the "H" clip 23 having paired upwardly extending arms 30 and 31, and having paired downwardly extending arms 29 and 28. The interchangeable block dies 16 and 24 are nestingly receiving within the channel defined by arms 30 and 31 of "H" clip 23, such arms preferably biasing inwardly upon said dies and clamping said dies in place in the manner of a spring clip.

Referring further simultaneously to FIGS. 1 and 2, "H" clip mounting means preferably comprising a cantilevered arm having a proximal end 13 and a distal end 14 is referred to generally by Reference Arrow 10. Preferably, the cantilevered arm "H" clip mounting means 10 has a "J" shaped cross-sectional shape, the upturned distal or tail end of the "J" being nestingly received by the downwardly extending arms 28 and 29 of "H" clip 23. Similarly, with the clamping action of the upper arms 30 and 31 upon interchangeable dies 16 and 24, arms 28 and 29 preferably inwardly bias against the upturned distal end 14 in the manner of a spring clip. Preferably, an upper edge of the upturned distal end 14 of arm 10 has a chamfered face 33 which facilitates outwardly splaying of arms 28 and 29 upon downward installation of "H" clip 23 thereover. Preferably, adhesive bonds 11, 12, and 22 securely and fixedly attach the proximal end 13 of cantilevered arm 10 upon the platen, such bonds utilizing the lower surface of plate 3 and side and lower surfaces of wall 9 as gluing surfaces.

Figure 3:
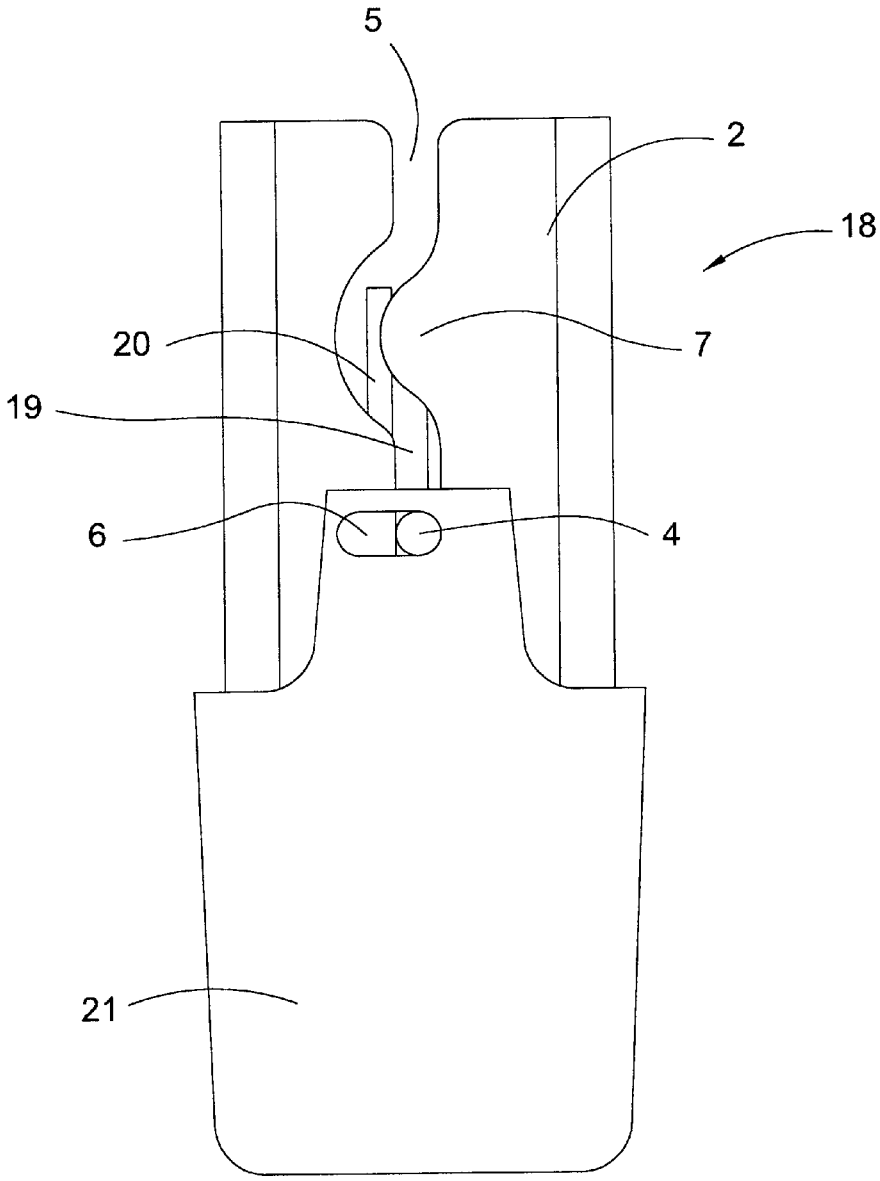
FIG. 3 depicts the inventive self-inking ink stamp mounted within a common self-inking stamp housing.

Referring simultaneously to FIGS. 1 and 3, the instant inventive self-inking ink stamp is shown in an upright stamping and die interchanging position in FIG. 1, and is shown in FIG. 3 inverted in an inking position within a common ink stamp housing referred to generally by Reference Arrow 18. Upon slidable downward movement of upper sleeve 2 of housing 18 into such housing's lower ink stamp chamber 21, the lower walls of slots 6 drive lugs or journals 4 of ink stamp 1 upwardly, driving the ink stamp 1 upwardly along curved slot 5. Fixed pivot lugs (not depicted within view of FIG. 3) extend inwardly and oppositely from radius points 7, such lugs protruding into slide channels 19 of slide tracks 20 of ink stamp 1. Upon such upward motion of the self-inking ink stamp 1 along slot 5, lugs 4 are carried by slots 6 along slots 5 and around radius points 7, rotating the ink stamp 1 from the depicted inking position to the position depicted in FIG. 1. Upon completion of such motion, ink stamping may occur, or stamping dies 16 and 24 may be interchanged.

Referring simultaneously to FIGS. 1 and 2, forceps (not depicted) may be utilized for upwardly withdrawing the "H" clip 23 and its received stamping dies 16 and 24 from slot 8; one arm of the forceps extending downwardly through gap 32 for frictional engagement with the inwardly facing wall of "H" clip 23, and the opposite arm of the forceps frictionally engaging the outwardly facing wall of "H" clip 23. Upon such extraction of the "H" clip and die assembly, dies 16 and 24 may be manually withdrawn from the "H" clip 23, and such dies may be manually replaced with alternate dies having different print characters. Thereafter, the newly configured "H" clip and die assembly may be either manually reinstalled over the distal end 14 of cantilevered arm 10, or forceps may be utilized for reinstallation.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A self-inking ink stamp comprising:

(a) a platen having upper and lower surfaces, having a slot or aperture extending from the lower surface to the upper surface, and comprising means for rotating and linearly moving the upper surface between an inking position and a stamping position;

(b) an "H" clip;

(c) a first ink stamping die having an upper end, the "H" clip receiving the first ink stamping die;

(d) mounting means interconnecting the "H" clip and the platen, the mounting means upwardly extending the first ink stamping die through the platen's slot or aperture.

2. The self-inking ink stamp of claim 1 further comprising a second ink stamping die having an upper end and being adhesively mounted upon the upper surface of the platen, and wherein the "H" clip mounting means comprises a cantilevered arm having a proximal end and a distal end, the proximal end of the cantilevered arm being fixedly attached to or formed wholly with the platen, the "H" clip further receiving the distal end of the cantilevered arm.

3. The self-inking ink stamp of claim 2 wherein the cantilevered arm has a "J" shaped cross section.

4. The self-inking ink stamp of claim 2 wherein the platen, the "H" clip, and the cantilevered arm comprise plastic, and wherein the first and second ink stamping dies comprise an elastomeric material.

5. The self-inking ink stamp of claim 4 further comprising a third ink stamping die, the "H" clip further receiving the third ink stamping die.

6. The self-inking ink stamp of claim 5 wherein the means for rotating and linearly moving comprises oppositely extending lugs, downwardly extending slide tracks, and a reinforcing wall spanning between and interconnecting the slide tracks.

7. The self-inking ink stamp of claim 1 wherein the "H" clip has a pair of downwardly extending and elastically splayable arms, said arms biasing inwardly upon the distal end of the cantilevered arm.

8. The self-inking ink stamp of claim 5 wherein the upper end of the second ink stamping die extends upwardly above the upper surface of the platen to an elevation, and wherein the upward extension of the first ink stamping die raises the upper end of said first ink stamping die to said elevation.

9. The self-inking ink stamp of claim 8 wherein the distal end of the cantilevered arm has a chamfered edge.

* * * * *